US008553918B2

(12) United States Patent
Kasztelan et al.

(10) Patent No.: US 8,553,918 B2
(45) Date of Patent: Oct. 8, 2013

(54) BATTERY CONTACT FOR A HEARING APPARATUS

(75) Inventors: Thomas Kasztelan, Erlangen (DE); Vincent Ong, Singapore (SG); Lit Min Sam, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1223 days.

(21) Appl. No.: 11/701,999

(22) Filed: Feb. 2, 2007

(65) Prior Publication Data

US 2007/0183614 A1 Aug. 9, 2007

(30) Foreign Application Priority Data

Feb. 6, 2006 (DE) ..... 10 2006 005 286

(51) Int. Cl.
*H04R 25/00* (2006.01)

(52) U.S. Cl.
USPC ..... 381/323; 381/324

(58) Field of Classification Search
USPC ..... 381/323; 429/157, 178; 320/107–108
See application file for complete search history.

(56) References Cited

U.S. PATENT DOCUMENTS 3,701,862 A * 10/1972 Vignini ..... 429/97
4,941,180 A * 7/1990 Buettner ..... 381/323
4,993,973 A * 2/1991 Selinko ..... 439/627
6,635,383 B2 * 10/2003 Maple ..... 429/178
6,641,952 B2 * 11/2003 Maple ..... 429/157
6,829,364 B2 12/2004 Andersen et al.
7,260,234 B2 * 8/2007 Kasztelan et al. ..... 381/324
7,292,700 B1 * 11/2007 Engbert et al. ..... 381/324

FOREIGN PATENT DOCUMENTS

DE 19712236 C1 10/1998
DE 198 09 567 C2 9/1999
WO WO 03/001844 1/2003

OTHER PUBLICATIONS

Negativer Batteriepol als Spiralfeder eines Radio Typ Sony ICF-SW20 aus dem Jahr 1989; Others.
Beleg des Herstellungsjahres des Radios Typ Sony ICF-SW20 aus dem Jahr 1989; Others.
Verpackung des Radios Typ Sony ICF-SW20 aus dem Jahr 1989; Others.
Garantieschein mit Vermerk des Kaufdatums Sep. 22, 1993 des Radios Typ Sony ICF-SW20 aus dem Jahr 1989; Others.

* cited by examiner

*Primary Examiner* — Davetta W Goins
*Assistant Examiner* — Phylesha Dabney

(57) ABSTRACT

A hearing device or another hearing apparatus is to be made smaller in terms of its dimensions. It is proposed for this purpose to develop a battery contact at least in one section as an induction coil. The current produced by the battery can thus compensate for an interference field of a telephone coil, said interference field being produced for example by a hearing device earpiece, and no separate coils need to be provided.

20 Claims, 1 Drawing Sheet

BATTERY CONTACT FOR A HEARING APPARATUS

CROSS REFERENCE TO RELATED APPLICATIONS

This application claims priority of German application No. 10 2006 005 286.2 filed Feb. 6, 2006, which is incorporated by reference herein in its entirety.

FIELD OF THE INVENTION

The present invention relates to a battery contact apparatus for a hearing apparatus, in particular a hearing device, with a first contact for contacting a first pole of a battery and a second contact for contacting a second pole of the battery.

BACKGROUND OF THE INVENTION

In hearing devices and optionally also in other hearing apparatuses, telephone coils are frequently provided, with which telephone signals can be inductively received and emitted. The inductive transmission is however comparatively susceptible to interference when additional electrical and/or magnetic components are located in the vicinity of the transmission path. In particular the electromagnetic earpiece of a hearing device has been found to interfere with the received or emitted signals of a telephone coil. It has furthermore been established that the battery contacts of a hearing device also act as jamming transmitters. Depending on their form and current flow they produce more or less strong magnetic fields and thereby reduce the signal-to-noise ratio in signal transmission using the telephone coil.

Until now this has been addressed by positioning a compensating coil in an appropriate manner in the hearing device such that the interference fields produced by the magnetic earpiece or battery contacts are compensated for as far as possible. One disadvantage of this compensation is that the compensating coils used are comparatively voluminous. In hearing devices in particular this is generally unacceptable, to such an extent that such compensating coils must frequently be dispensed with.

A hearing device is known from DE 198 09 567 C2, in which in order to suppress genetic interference fields a second induction coil is provided in parallel to a first induction coil. The induction voltages produced counteract each other due to the inverse circuit, and interference signals can be minimized as a result.

A hearing device is known from WO 03/001844 A1 in which the magnetic interference effect is diminished by means of a compensating coil and a capacitor connected in parallel to a battery.

SUMMARY OF THE INVENTION

The object of the present invention consists in reducing interference from telephone coils caused by battery contacts.

This object is achieved in accordance with the invention by a battery contact apparatus for a hearing apparatus, in particular a hearing device, with a first contact for contacting a first pole of a battery and a second contact for contacting a second pole of the battery, with the second contact being developed at least in one section as an induction coil through which the current produced by the battery can be discharged.

Advantageously one of the battery contacts thus receives the dual functionality of battery contacting and interference field compensation. The installation space for a separate compensating coil can thus be saved.

The induction coil acting as a contact is preferably spiral-shaped. A high compensation effect can thus be achieved with a very low space requirement.

A contact area can be provided at the center of the coil in order to contact the corresponding battery pole. Thus smaller battery poles can also be contacted. It is in principle, however, also possible for the battery pole to be contacted in the exterior surface of the coil. In this case the current is subsequently fed outwards from the center of the spiral. This variant allows good contact to be achieved with correspondingly larger pole surfaces.

According to a particularly preferred embodiment a first contact force can be exerted on the first battery pole with the first contact, and a second contact force can be exerted on the second battery pole with the second contact, and the two contact forces are essentially arranged perpendicular to one another. This allows one of the two contacts to contact the battery for example from above and the other contact to contact the battery from the side. This spatial arrangement allows interferences to be reduced further.

BRIEF DESCRIPTION OF THE DRAWINGS

The present invention is now described in more detail below with reference to the appended drawings.

DETAILED DESCRIPTION OF THE INVENTION

Figure 1:
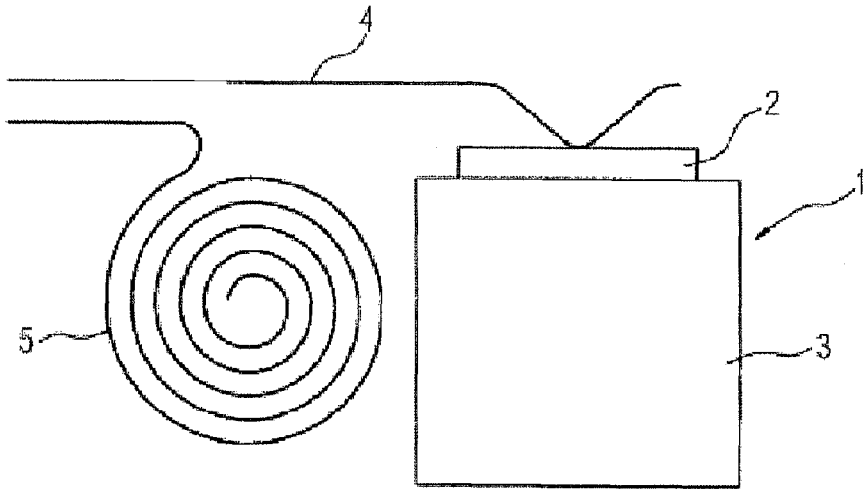
FIG. 1 shows a basic sketch of an example embodiment of a power supply apparatus according to aspects of the invention.

The exemplary embodiment described in more detail below represents a preferred embodiment of the present invention.

A hearing device is supplied with power by means of a battery 1. This battery 1 is essentially cylindrical and features a first pole 2 on its front side and a second pole 3 on the shell or on the opposite front side. The pole 2 located on or above the face generally represents the positive pole of the battery. The shell forms the negative pole 3 of the battery.

In the example shown in the figure, the positive pole 2 of the battery is contacted using a conventional contact spring 4. The negative pole 3 of the battery 1 is formed using an inventive spiral-shaped contact 5, which acts as a coil. The first contact 4 can thus also be referred to as a positive battery contact and the spiral-shaped contact 5 as a negative battery contact.

When the hearing device draws power via the contacts 4 and 5, an electromagnetic interference field is generated by the current flow in the contacts. However this interference field is reduced on account of the lateral positioning of the negative battery contact 5. Any interference field in an electromagnetic earpiece is furthermore compensated by the coil at the contact 5. Precise alignment and arrangement of the coil at the contact 5 is integral to the reduction. Moreover the number of windings also plays a significant role in the compensation. Account must also be taken of the winding direction for a successful compensation. However all these parameters are dependent on the specific design of the hearing device. Therefore the design, position and orientation of the coil of the contact 5 must be adjusted to the spatial design of the hearing device and its electric circuitry. This adjustment can only be performed individually for each hearing device.

Figure 2:
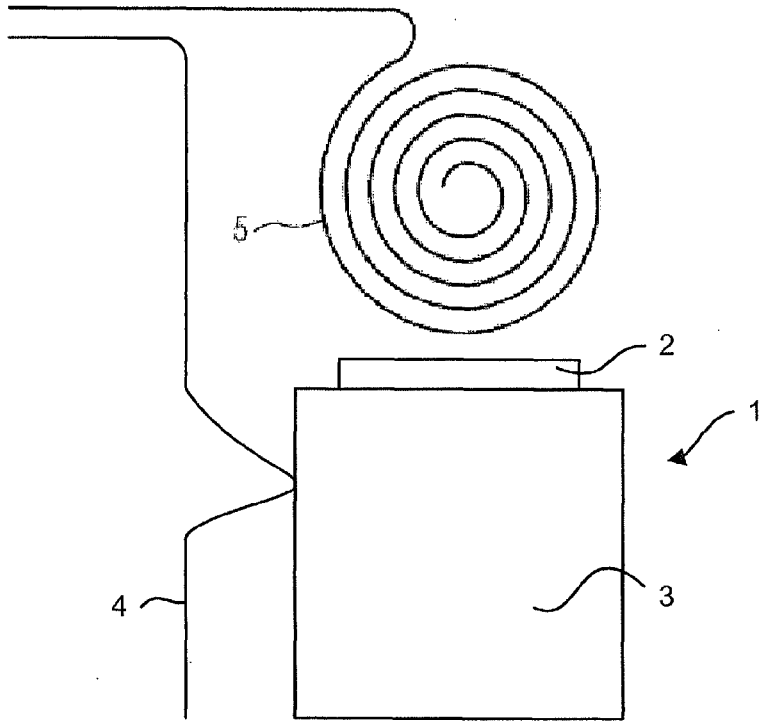
FIG. 2 shows a sketch of another example embodiment of a power supply apparatus according to aspects of the invention.

In another example embodiment of a hearing device power supply it can be advantageous for instance for the positive contact 2 of the battery contact apparatus to be fitted with a coil 5 and for the negative contact 3 to be of a conventional design, as illustrated in FIG. 2. Furthermore both contacts can also be fitted with a coil.

The interference field of the battery contacts 4, 5 is reduced due to the positioning of the contact 5 with the coil on the side of the battery 1 as represented in the figure. However it may also be advantageous to arrange the contact with the coil on the underside of the battery, in other words opposite the positive pole 2. However the lateral positioning of the battery contact 5 will for the most part reduce the interference field of the battery contact and the embodiment of this contact 5 as a coil will largely compensate for the interference field of the hearing device earpiece. An individual compensation coil is thus no longer necessary and the overall size of the hearing device can be reduced.

Instead of the spiral-shaped coil of the contact 5, a helical coil which is integrated into the contact 5 can also be provided. Although this coil shape increases the necessary installation space, it can be advantageous with regard to the contact force and coil effect.

In order to avoid short circuits in the coil, parts of the coil or the coil wire can be isolated. The inventive effect of the interference field compensation can thus also be maintained in the event of a change in the shape of the coil, as generally occurs upon contact with the battery poles.

The coupling factor with reference to the coupling of interference in the telephone coil of a hearing device is reduced overall by the coil which is built into the battery contact. The hearing device can accordingly be operated with a higher signal-to-noise ratio.

The invention claimed is:

1. A battery contact apparatus for a hearing apparatus, comprising:

a first contact that contacts a first pole of a battery; and a second contact that contacts a second pole of the battery and comprises an induction coil, wherein the induction coil conducts all of a current generated by the battery, and wherein a structural and a positional arrangement of the induction coil relative to circuitry of the hearing device is configured so that an electromagnetic field generated by the induction coil is effective to compensate for an electromagnetic interference field generated by the circuitry of the hearing device.

2. The battery contact apparatus as claimed in claim 1, wherein the induction coil is spirally arranged.

3. The battery contact apparatus as claimed in claim 2, wherein the spirally arranged induction coil comprises a contact area that contacts the second pole of the battery.

4. The battery contact apparatus as claimed in claim 3, wherein the contact area is arranged in a center of the induction coil.

5. The battery contact apparatus as claimed in claim 1, wherein a first contact force is exerted on the first pole of the battery with the first contact.

6. The battery contact apparatus as claimed in claim 5, wherein a second contact force generated by a resilience of the induction coil is exerted on the second pole of the battery with the second contact.

7. The battery contact apparatus as claimed in claim 6, wherein the first contact force is arranged essentially perpendicular to the second contact force.

8. The battery contact apparatus as claimed in claim 1, wherein the induction coil is partially isolated.

9. The battery contact apparatus as claimed in claim 1, wherein a part of the induction coil is isolated such that it retains its shape and compensation effect whether or not a second contact force is exerted on the second contact that is effective to change a shape of the second contact.

10. The battery contact apparatus as claimed in claim 1, wherein a position and an orientation of the induction coil is adjusted according to the hearing apparatus.

11. The battery contact apparatus as claimed in claim 1, wherein the hearing apparatus is a hearing device.

12. The hearing apparatus of claim 1, wherein the induction coil comprises a helical shape, and wherein a second contact force generated by a resilience of the induction coil is exerted on the second pole of the battery with the second contact.

13. A power supply system for a hearing apparatus, comprising:

a battery with a first pole and a second pole;

a first contact that contacts the first pole of the battery; and a second contact that contacts the second pole of the battery, wherein the second contact is disposed on a turn of an induction coil that discharges a current generated by the battery, wherein a structural and a positional arrangement of the induction coil relative to an electromagnetic earpiece of the hearing device is configured so that an electromagnetic field generated by the induction coil is effective to compensate for an electromagnetic interference field generated by the electromagnetic earpiece.

14. The power supply system as claimed in claim 13, wherein the first pole of the battery comprises a first surface section that contacts the first contact.

15. The power supply system as claimed in claim 14, wherein the second pole of the battery comprises a second surface section that contacts the second contact.

16. The power supply system as claimed in claim 15, wherein the first surface section is arranged essentially perpendicular to the second surface section.

17. A hearing apparatus subject to an electromagnetic interference field, comprising:

a battery;

circuitry powered by the battery;

a contact touching the battery and supplying current generated by the battery to the circuitry;

wherein the contact comprises a dual functioning induction coil; and wherein the induction coil touches the battery at an exterior surface of the coil remote from an end of the coil to create a current flow from the battery to the circuitry and to generate an electromagnetic field, wherein a structural and a positional arrangement of the induction coil relative to the circuitry is configured so that the electromagnetic field generated by the induction coil is effective to compensate for the electromagnetic interference field generated by the circuitry of the hearing device.

18. The hearing apparatus of claim 17, wherein the induction coil comprises a spiral wind.

19. The hearing apparatus of claim 18, wherein the spiral wind is essentially planar.

20. The hearing apparatus of claim 17, wherein the induction coil comprises a helical wind.

* * * * *